United States Patent [19]

Buente et al.

[11] 4,373,477

[45] Feb. 15, 1983

[54] LASH ADJUSTER WITH PLUNGER RETAINER

[75] Inventors: Stephen M. Buente, Kalamazoo; George A. Hillebrand, Battle Creek, both of Mich.

[73] Assignee: Eaton Corporation, Cleveland, Ohio

[21] Appl. No.: 220,490

[22] Filed: Dec. 29, 1980

[51] Int. Cl.[3] ..... F01L 1/24; F01L 1/14

[52] U.S. Cl. ..... 123/90.55; 123/90.46

[58] Field of Search ..... 123/90.46, 90.52, 90.55, 123/90.56, 90.57, 90.58

[56] References Cited

U.S. PATENT DOCUMENTS

| | | | |
|---|---|---|---|
| 3,140,698 | 7/1964 | Voorhies | 123/90.55 |
| 3,286,702 | 11/1966 | Dadd | 123/90.55 |
| 3,877,446 | 4/1975 | Morgan | 123/90.55 |

FOREIGN PATENT DOCUMENTS

| | | | |
|---|---|---|---|
| 2652154 | 5/1978 | Fed. Rep. of Germany | 123/90.46 |
| 2758957 | 7/1979 | Fed. Rep. of Germany | 123/90.55 |

*Primary Examiner*—Craig R. Feinberg
*Assistant Examiner*—W. R. Wolfe
*Attorney, Agent, or Firm*—Charles H. Grace; J. Gordon Lewis

[57] ABSTRACT

A lash adjuster 10 is disclosed for use in engine valve gear. The adjuster includes a body 40 and a plunger 50 is slidably received in a bore 48 formed in body. A piston 63 is slidably received in the plunger and forms a high pressure chamber 86 within the plunger. A one-way valve means 72 is disposed intermediate the piston and plunger for admitting fluid to the chamber for lash adjustment. An annular retaining clip 90 is seated in a locking position in a groove 106 formed in an outer wall 104 of the plunger body. The clip extends radially beyond the end face of the hub bore 48 thereby preventing fall out of the plunger body prior to assembly in the engine valve gear.

8 Claims, 8 Drawing Figures

LASH ADJUSTER WITH PLUNGER RETAINER

BACKGROUND OF THE INVENTION

This invention relates to hydraulic lash adjusters and is particularly directed to adjusters having a means for retaining the adjuster plunger subassembly to the adjuster body.

DESCRIPTION OF THE PRIOR ART

Lash adjusters of the hydraulic type are used in direct acting valve gear and also those types of valve gear having the lash adjuster located in the rocker arm with the lash adjuster contacting either a cam surface or valve stem. Such lash adjusters may require a retaining means for securing the plunger subassembly in the adjuster bore to maintain integrity of the subassembly prior to assembly into the engine valve gear. It should be noted that once the lash adjuster is assembled to the valve gear, the plunger subassembly retainer performs no function during engine operation.

Known techniques for retaining the integrity of the plunger subassembly include spring steel snap rings mounted either in a groove formed into the adjuster body bore in which the plunger assembly is received or a groove formed in the outer wall of the plunger. In either case, the snap ring prevents removal of the plunger subassembly by forming an interference condition between the adjuster body and the plunger.

In smaller size adjusters, space limitations require that the snap ring wire size and its mounting groove be proportioned accordingly, thus resulting in small sizes, close tolerances, and consequent higher manufacturing costs.

Resilient O-ring seals mounted in the plunger subassembly outer wall have also been used in place of steel snap rings. Where O-rings have been used problems with contamination have resulted in damage to the O-ring from cutting during assembly.

A need has thus arisen for a plunger subassembly retainer which can be assembled into a closed ended adjuster bore without the use of special tools or fixturing. The retainer must also be low in cost compared to known techniques.

In addition, the retainer must lend itself into high volume production methods and not require precision manufacturing tolerances. Furthermore the retainer should preferably be mountable within the adjuster fluid reservoir in order to minimize adjuster overall length, and consequently the inertia of the adjuster. Minimizing adjuster inertia is important since engine operating speeds can exceed 5,000 rpm.

SUMMARY OF THE INVENTION

The present invention provides a hydraulic lash adjuster used in valve gear for internal combustion engines. The present invention is particularly applicable to valve gear for engines operating at high rpm.

The adjuster includes an outer body portion having a bore and a plunger subassembly received therein.

The plunger subassembly includes a piston received in a bore formed in the plunger body. A one-way ball check-valve is mounted in a cavity defined by the end of the piston and the end surface portions of the bore in the plunger body.

The lash adjuster of the present invention includes a unique plunger sub-assembly retaining means which facilitates installation of the tappet in the engine valve gear. The retaining means comprises a thin walled, elastically deformable, resilient, tubular clip having narrow width, radial lip portions extending inwardly on one end thereof. The clip is also longitudinally split to permit radial expansion. The clip is connected to a first annular groove formed on one end of the plunger subassembly body by snapping the lip portions of the clip into the groove. The first groove and its adjacent shoulder are sized to permit the outer peripheral surfaces of the clip to remain within the outer diameter of the plunger body. The plunger subassembly with the clip attached in this manner can then be inserted into the corresponding guide bore in the tappet bucket.

While in the first groove, the side wall of the tubular clip extends beyond the end of the plunger subassembly opposite the cam engaging face. As the plunger is inserted farther into the bucket bore, the free end of the clip bottoms out against the bucket inside end face. Continued insertion of the plunger causes the lip end of the clip to expand outward radially as urged by an outwardly tapered surface beneath the first groove. The clip then is forced over a portion of the plunger body outer diameter whereupon the lip end of the clip snaps into a second annular groove. The second groove has a bottom diameter sized to permit the inside surface of the clip to conform to the outer surface of the plunger. The outside surface of the clip then extends beyond the bore internal diameter through which it has previously passed unobstructed, thereby preventing removal of the plunger assembly.

A groove is located around the lower exposed end of the plunger and provides a mounting surface for a plunger removal tool.

BRIEF DESCRIPTION OF THE DRAWINGS

FIG. 8 is a schematic view in partial cross-section of the invention as embodied in a lash adjuster mounted in a rocker arm.

DETAILED DESCRIPTION

Figure 1:
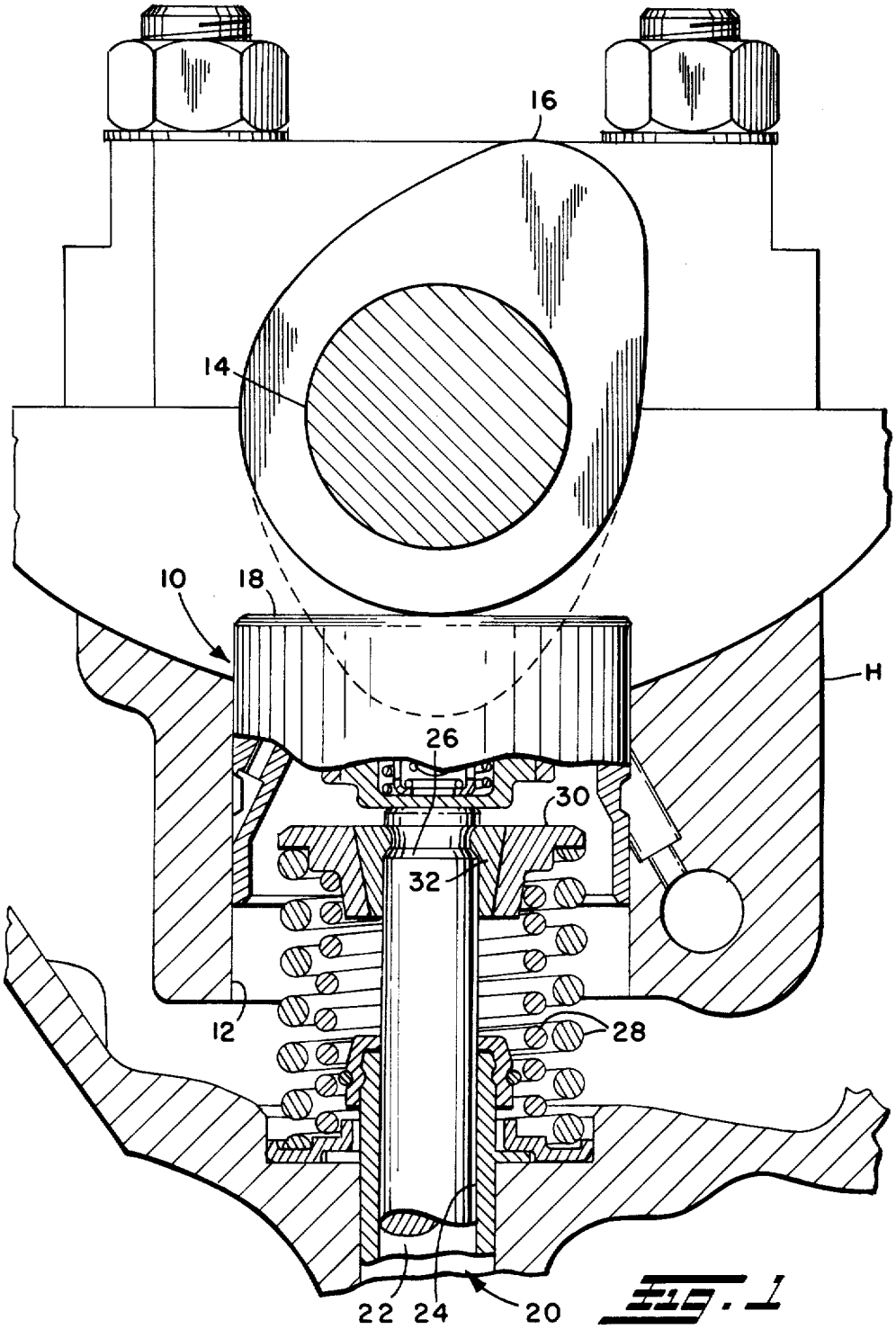
FIG. 1 is a cross-section of a portion of the direct acting valve gear of an internal combustion engine illustrating the invention embodied as a bucket type lash adjuster installed in engine valve gear.

Referring now to FIG. 1, a lash adjuster or tappet embodying the principles of the invention is indicated generally at 10 and is slidably received in a guide bore 12 provided in the cylinder head H of the engine structure. A camshaft 14 having a cam lobe 16 contacts the upper end or cam face 18 of the tappet. A typical combustion chamber valve 20 is shown seated on a valve seating surface formed in the cylinder head H with the stem portion 22 of the valve extending substantially vertically upward through a valve guide 24 formed in the cylinder head H, with the upper end 26 of the valve stem contacting the lower end of the tappet. The valve is biased to the closed position by a valve spring 28 having its lower end registering against the exterior of the upper portion of the valve guide 24 and its upper end in contact with a retainer 30 secured to the valve stem adjacent its upper end and retained thereon in a suitable manner as, for example, by the use of a split keeper 32 which is well known in the art.

Figure 2:
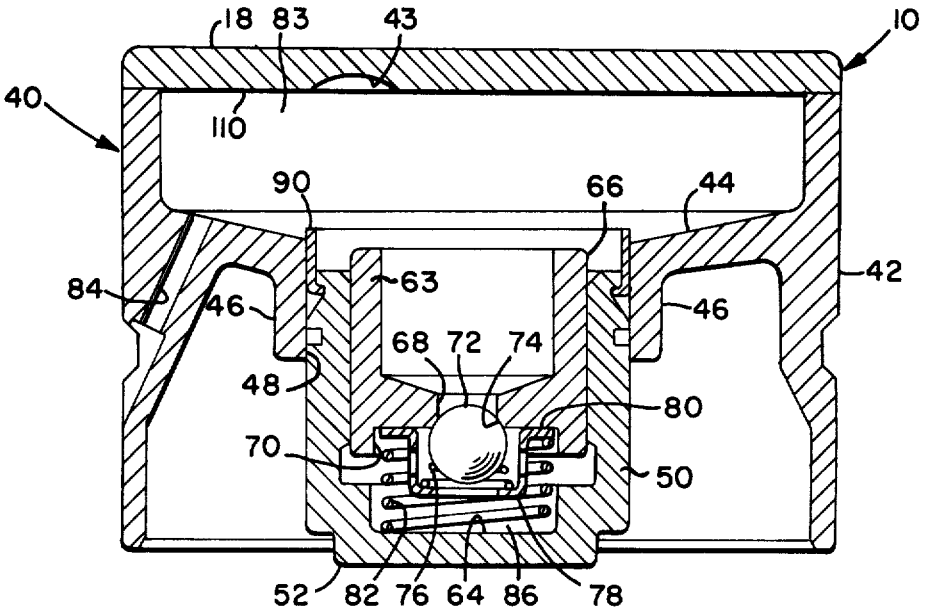
FIG. 2 is a cross-sectional view of the lash adjuster of FIG. 1 with the plunger subassembly partially inserted into the adjuster body.
Figure 3:
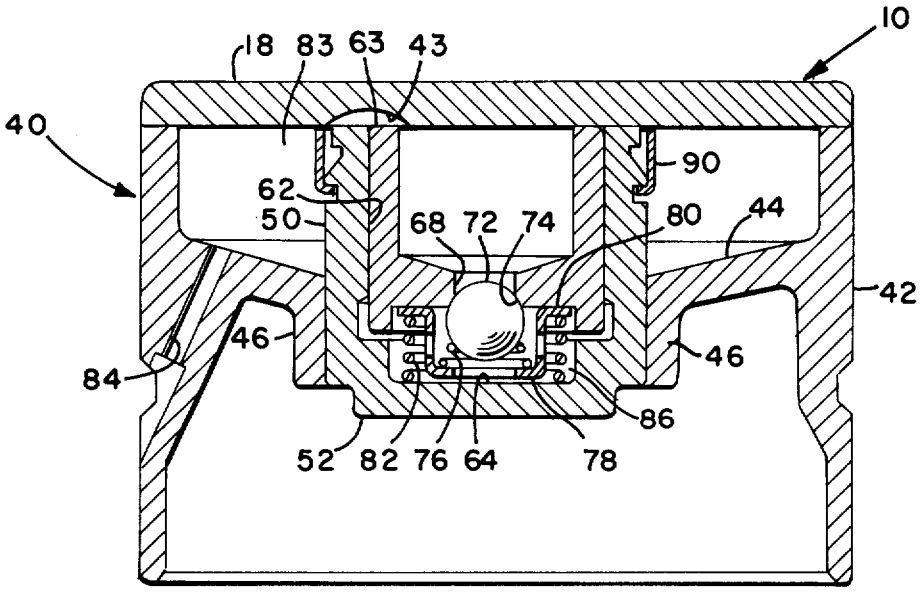
FIG. 3 is a cross-sectional view of the adjuster with the plunger subassembly bottomed out in the adjuster body.

Referring now to FIGS. 2 and 3, adjuster 10 is shown wherein the body, indicated generally at 40, is shown as formed integrally with an outer tubular wall portion 42 having a transverse web 44 extending generally radially inwardly from the inner periphery of the outer tubular wall portion at a location intermediate the ends thereof. The web 44 has formed therewith a tubular hub portion 46 formed about the inner periphery of the web 44 with the hub 46 extending axially from the web in a downward direction with respect to FIGS. 2 and 3. A bore 48 is formed through hub 46. The hub 46 has the inner periphery of bore 48 extending in generally parallel relationship to the outer periphery of the tubular wall portion 42. The outer periphery of the tubular wall portion 42 is sized to be received in the adjuster guide bore 12 (see FIG. 1) in a generally closely fitting relationship. Cam face member 18 has a relatively thin disc-shaped configuration is joined about the outer periphery thereof with the upper end of the tubular body portion 42 in a suitable manner, as for example, laser fusion weldment. A fluid by-pass recess 43 is formed in the underface of member 18, the function of which will be hereinafter described.

A plunger body 50 is received in closely fitting, sliding relationship with the interior surface of bore 48. The plunger body 50 has the transverse face 52 thereof adapted for driving engagement with the end 26 (see FIG. 1) of the combustion chamber valve stem.

The plunger body 50 has a precision cylindrical bore 62 formed in the upper end thereof with the lower end thereof terminating in a shouldered flat bottom 64. The precision bore 62 has slidably received therein in very closely fitting relationship a piston member 63, the outer periphery 66 thereof being of precision diameter and smoothness so as to provide control of the leak-down or passage of pressurized engine lubricant therebetween.

The piston 63 has a fluid passage 68 formed vertically therethrough with a counterbore 70 (FIG. 2) formed therein. An annular seating surface 74 is formed at the bottom of passage 68. A one-way valve member in the form of check-ball 72 rests against the annular seating surface 74 and is biased thereagainst by a conical check-ball spring 76. The check-ball 72 is retained by a cage 78 which has an outwardly extending flange 80 received in counterbore 70 and retained therein by suitable means as, for example, a press fit. The subassembly of the check-ball, cage and piston is biased upwardly by a plunger spring 82 having its upper end registering against the flange 80 of the check-ball cage and its lower end contacting the bottom 64 of the plunger.

The area surrounding the plunger body 50 above the web 44 and bounded by the under surface of cam face member 18 comprises a first portion 83 fluid reservoir which is communicated with the region externally of the body periphery 42 by a passageway 84 provided through the outer tubular wall of the tappet body and the web 44. The by-pass recess 43 functions to maintain the space bounded by piston 63 in continuous fluid communication with reservoir 83. It will be understood the piston is maintained in the upward extreme position and against the undersurface of member 18, as illustrated in FIG. 7 by spring 82 and the hydraulic pressure in chamber 86.

The region 86 below the piston check-ball and seat 74 and bounded by the bore and bottom 64 of the plunger body comprises a high pressure fluid chamber for retaining therein fluid entering through passage 68 upon opening of the check-ball 72.

Figure 4:
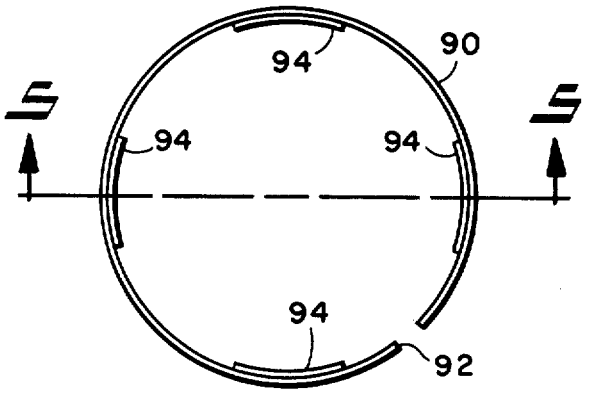
FIG. 4 is a top view of the split retaining clip.
Figure 5:
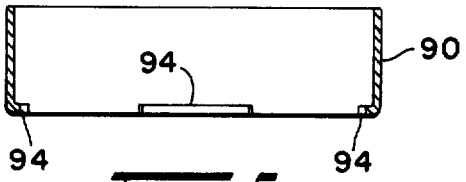
FIG. 5 is a cross-sectional view taken along section lines 5—5 of FIG. 4.
Figure 7:
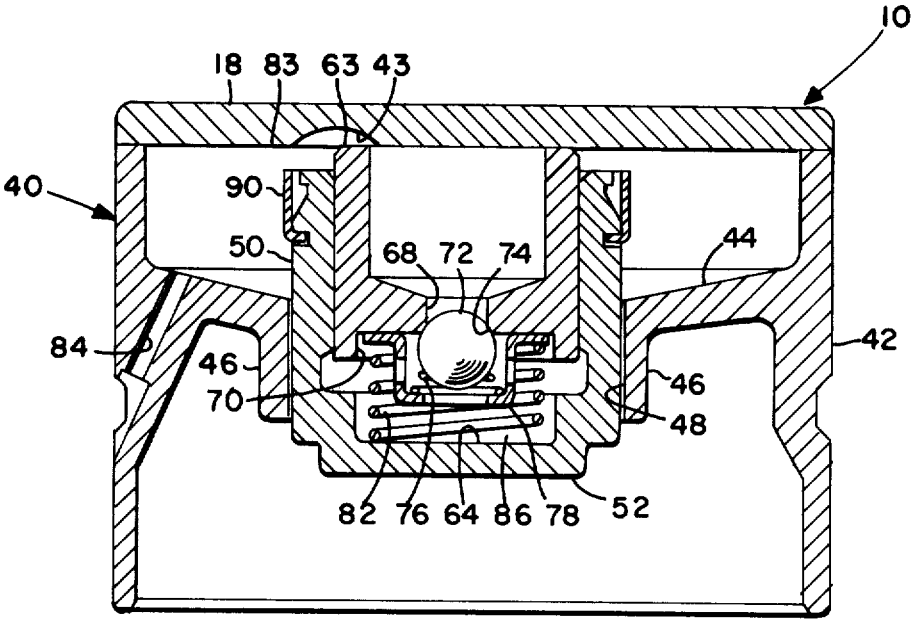
FIG. 7 is a cross-sectional view of the adjuster with the plunger assembly in a typical operating position and the retaining clip in the locking position.
Figure 6:
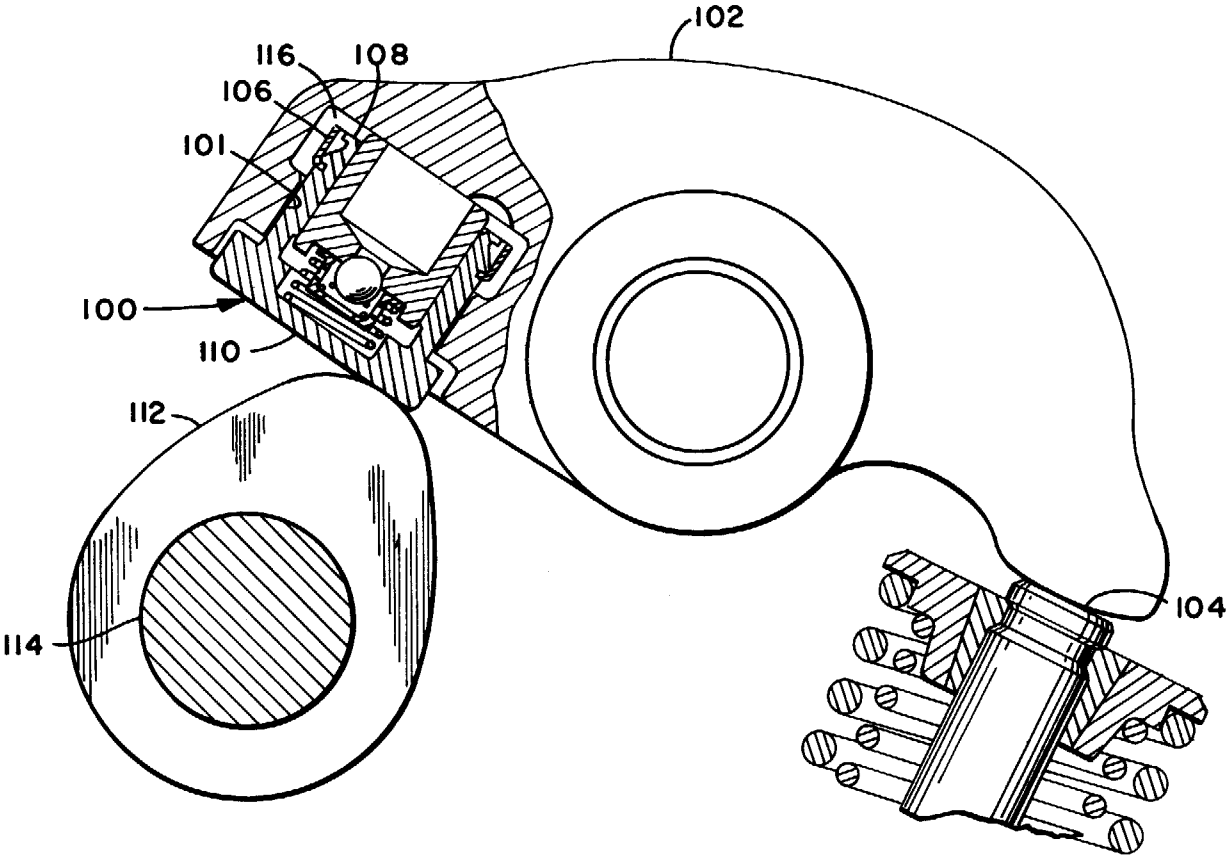

As shown in FIGS. 2, 3, and 7, a retaining clip 90 is connected to the upper end of plunger body 50 and in the FIGS. 3 and 7 positions prevents removal of the plunger subassembly from bore 48. Referring now to FIGS. 4 and 5, clip 90 is a thin walled annular member having a longitudinal slit or opening 92 therein for permitting radial expansion of the clip. In the preferred form of the invention, clip 90 is fabricated from a suitably tempered spring steel. Four equally spaced radially inwardly extending lip portions 94 are formed on the lower end of the clip.

It should be noted that alternate lip configurations can be utilized without departing from the scope of the invention, for example, by increasing or decreasing the number of lips or by utilizing a continuous lip configuration.

Figure 6:
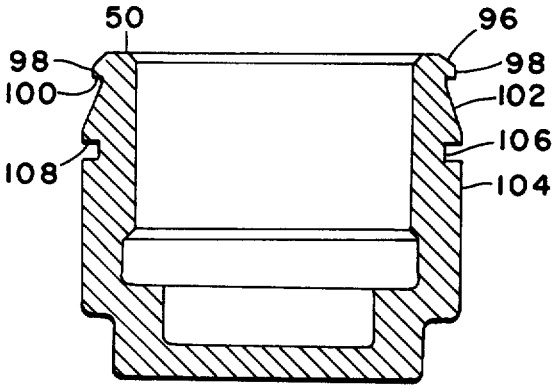
FIG. 6 is a cross-sectional view of the plunger body shown in FIGS. 2, 3, and 7.

Retaining clip 90 is assembled to plunger body 50 by first aligning the lip end of the clip over chamfered end surface 96 formed on the upper end of plunger body 50 as shown in FIG. 6. By applying a downward axial load to the clip, the internal peripheral surfaces of lips 94 engage with chamfered surface 96 whereupon clip 90 is expanded outward radially and slides over a cylindrical surface portion 98 formed beneath chamfer 96. Continued downward movement of clip 90 toward the plunger body results in lips 94 snapping beneath a transverse shoulder portion 100 formed beneath outer diameter portion 98. FIG. 2 shows the position of clip 90 in engagement with surface 98 which is also designated as a first position. Cylindrical surface portion 98 has been sized to permit passage of clip 90 through bore 48. A tapered surface portion 102 intersects with transverse shoulder 100 and merges into an outer peripheral surface 104 of plunger body 50. An annular groove 106 is formed into outer surface 104.

The plunger subassembly with retaining clip 90 connected to the upper end of plunger body 50 in the first position is assembled to adjuster body 40 by insertion into bore 48. FIG. 2 shows the plunger subassembly and retaining clip partially inserted into bore 48. Retaining clip 90 is movable to a locking or second position by forcing the plunger subassembly upwardly until the upper end of the retaining clip abuts against an internal transverse surface 110 formed beneath cam face 18. Continued upward movement of the plunger results in tapered surface portion 102 radially expanding clip 90 which then slides relative to plunger body 50 in telescopic fashion until lips 94 snap into groove 106. Groove 106 and the portion of outer peripheral surface 104 immediately above groove 106 are also designated as second registration means. Outer diameter portion 98 and transverse shoulder 100 are designated as first registration surface means.

In the locking position retaining clip 90 has been expanded radially outwardly and effectively prevents removal of the plunger subassembly from the tappet bucket thereby greatly facilitating assembly of the tappet to engine valve gear.

In operation, check-ball 72 is biased in a closed position by spring 76 and upon rotation of the camshaft in timed relationship to the events of the combustion chamber to the position shown in solid outline in FIG. 1, the upper surface of the tappet is registered against the base circle portion of the cam with the lobe 16 oriented so as not to contact the cam face 18 of the tappet. Upon rotation of the camshaft 14 to the position shown in dashed outline in FIG. 1, the cam load contacts the upper face 18 of the tappet, causing the tappet to move downwardly to the position indicated in dashed outline thereby opening the combustion chamber valve. Upon subsequent rotation of the camshaft to return to the solid outline position of FIG. 1, the valve event is complete and the valve is reseated on the valve seat.

With the engine cam lobe 16 in the position shown in FIG. 1, the plunger spring 82, aided by hydraulic pressure, maintains the upper end of the piston 63 in contact with the undersurface 110 of cam face member 18 and urges the plunger body 50 in the downward direction until the end face 52 thereof contacts the upper face 26 of the valve stem 22 thereby eliminating lash in the valve gear. This causes expansion of chamber 86 which draws open the check-ball 72 permitting fluid to flow into chamber 86. Upon cessation of the expansion of chamber 86, the check-ball 72 closes under the biasing spring 76. Upon subsequent rotation of the cam lobe 16, the ramp of the cam lobe begins to exert a downward force on the upper face 18 of the tappet tending to compress the piston 63 into bore 62 in the plunger, which compression is resisted by fluid trapped in chamber 86. The fluid trapped in the chamber 86 prevents substantial movement of the piston 63 relative to plunger body 50 and transmits the motion through the bottom face of plunger 52 onto the top of the valve stem 26. It will be understood by those having ordinary skill in the art that a minor movement of the plunger with respect to the piston occurs, the magnitude of which is controlled by the amount of fluid permitted to pass through the aforesaid leakdown surfaces 62 and 66. The piston 63 and plunger body 50 thus act as a rigid member transmitting further lifts of cam lobe 16 for opening the valve to the position shown by dashed line in FIG. 1.

Referring to FIG. 8, the invention is shown embodied in a lash adjuster, indicated generally at 100, integrally formed into a bore 101 in a pivotally mounted rocker arm 102. One end of rocker arm 102 is in contact with the upper end of a valve stem portion 104. Adjuster 100 includes a retaining clip 106 identical in construction to clip 90 and is connected to the upper end of a plunger body portion 108 which includes an enlarged lower end portion 110 which is engageable with a cam 112 mounted on a camshaft 114. Pressurized engine lubricant is communicated by a passageway in the rocker arm (not shown) to a fluid reservoir 116 defined by the space above bore 101.

The operation of adjuster 100 and the function of retainer clip 106 are identical with adjuster 10 of FIGS. 1–7.

It will be understood that although the present invention has been described with reference to bucket tappets for high rpm engine valve gear, the retaining means is applicable to other type lash adjusters employed in other types of valve gear, for example, tappet and pushrod type valve gear.

Although the invention has been described and illustrated hereinabove in the presently preferred practice, it will be apparent to those having ordinary skill in the art that modifications and variations of the invention may be made to the forms disclosed herein and the invention is limited only by the following claims.

What is claimed is:

1. A lash adjuster for valve gear of an internal combustion engine comprising:

(a) body means including structure defining a bore therethrough, said bore terminating in an internal face;

(b) plunger means slidably received in said bore, said plunger means including structure defining a plunger body having a bore therein with a piston slidably received in said bore in precision closely fitting relationship thereto, said piston and said plunger body cooperating to define a fluid pressure chamber therebetween;

(c) one-way valve means disposed in said plunger means and operable to permit flow of fluid into said fluid chamber upon movement of said piston in a direction outwardly of said plunger body;

(d) said plunger means and said body means defining a fluid reservoir for supplying fluid to said one-way valve means;

(e) said body means defining a passage for communicating pressurized fluid to said fluid reservoir; and (f) means for retaining said plunger means within said bore prior to assembly of said lash adjuster into said valve gear, said retaining means including, (i) said plunger body defining a ramp surface adjacent said end portion, (ii) fastener means including an elastically deformable member disposed in engagement with said plunger body, said ramp surface being operable upon insertion of said plunger means in said bore to elastically deform said member radially outwardly and subsequently cause said member to engage said plunger means in snap locking arrangement for preventing removal of said plunger means from said bore.

2. A lash adjuster for valve gear of an internal combustion engine comprising:

(a) body means defining a bore therein terminating in an internal face;

(b) plunger means slidably received within said bore; and (c) means for retaining said plunger means within said bore prior to assembly of said lash adjuster into said valve gear, said retaining means including, (i) said plunger means defining a ramp surface at an end thereof adjacent said internal face, and (ii) fastener means including a deformable member disposed in engagement with said plunger means, said ramp surface being operable upon insertion of said plunger means in said bore to elastically deform said member radially outwardly by the axial repositioning of said fastener means therealong and subsequently cause said member to engage said plunger means for preventing removal of said plunger means from said bore.

3. The device is defined in claim 2, wherein said fastener means is retained by registration surface means disposed adjacent the radially outwardmost extent of said ramp surface within said plunger means.

4. A lash adjuster for valve gear of an internal combustion engine comprising:

(a) body means including structure defining a bore therethrough, said bore terminating in an internal face;

(b) plunger means slidably received in said bore, said plunger means including structure defining a plunger body having a bore therein with a piston slidably received in said bore in precision closely fitting relationship thereto, said piston and said plunger body cooperating to define a fluid pressure chamber therebetween;

(c) one-way valve means disposed in said plunger means and operable to permit flow of fluid into said fluid chamber upon movement of said piston in a direction outwardly of said plunger body;

(d) said plunger means and said body means defining a fluid reservoir for supplying fluid to said one-way valve means;

(e) said body means defining a passage for communicating pressurized fluid to said fluid reservoir; and (f) means for retaining said plunger means within said bore prior to assembly of said lash adjuster into said valve gear, said retaining means including, (i) said plunger body defining a first registration surface means formed adjacent said end portion, a second registration surface means spaced from said first registration surface means, and means defining a ramp surface intermediate and linking said first and second registration surface means, (ii) fastener means disposed in engagement with said registration surface means in a first position and movable along said ramp surface for engagement with said second registration surface means in a second position, said fastener means including an elastically deformable member, whereupon insertion of said plunger means in said bore, said fastener means is moved along said ramp from said first position to said second position, during which movement said member is elastically deformed and in said second position engages said second registration means in snap-lock arrangement, whereby said member extends radially beyond said bore for preventing removal of said plunger means therefrom.

5. The device as defined in claim 4, wherein said annular member has a cylindrical outer surface, said annular member having an axial length such that in said second position the upper end thereof is aligned with the end of said plunger body.

6. The device as defined in claim 4, wherein said plunger body has a chamfered surface formed around the end thereof adjacent said first registration surface means.

7. The device as defined in claim 4, wherein, (a) said first registration surface means includes (i) a downwardly facing annular shoulder, (ii) an outer cylindrical surface portion intersecting with said annular shoulder and having an outer diameter sized less than the internal diameter of said hub to permit said fastener means annular member while in said first position to pass through said bore;

(b) said second registration surface means including an annular groove, said tapered surface means connecting the outer surface of said plunger body adjacent said annular groove and intersecting with said annular shoulder; and (c) said fastener means annular member having a thin walled tubular configuration with a radially inwardly extending lip portion formed on one end thereof, said annular member having a longitudinal slit therein for permitting said radial expansion of said annular member.

8. The device as defined in claim 7, wherein said lip portion includes a plurality of circumferentially spaced lip segments.

* * * * *